US012570455B2

(12) United States Patent
Zhai et al.

(10) Patent No.: US 12,570,455 B2
(45) Date of Patent: Mar. 10, 2026

(54) PROTECTIVE BRACKET AND USING METHOD THEREOF

(71) Applicant: KunShan-Go Visionox Opto-Electronics Co., Ltd, Kunshan (CN)

(72) Inventors: Jianpeng Zhai, Kunshan (CN); Yuchen Tian, Kunshan (CN)

(73) Assignee: KunShan Go-Visionox Opto-Electronics Co., Ltd, Kunshan (CN)

( * ) Notice: Subject to any disclaimer, the term of this patent is extended or adjusted under 35 U.S.C. 154(b) by 50 days.

(21) Appl. No.: 18/148,187

(22) Filed: Dec. 29, 2022

(65) Prior Publication Data

US 2023/0137505 A1 May 4, 2023

Related U.S. Application Data

(63) Continuation of application No. PCT/CN2021/107022, filed on Jul. 19, 2021.

(30) Foreign Application Priority Data

Oct. 22, 2020 (CN) ..... 202011142255.3

(51) Int. Cl.
*B65D 81/05* (2006.01)
*B65D 85/30* (2006.01)
(Continued)

(52) U.S. Cl.
CPC ..... *B65D 81/05* (2013.01); *B65D 85/30* (2013.01); *B65D 2581/055* (2013.01); *B65D 2585/6835* (2013.01)

(58) Field of Classification Search
CPC ..... B65D 2581/055; B65D 2585/6835; B65D 81/022; B65D 81/025; B65D 81/03;
(Continued)

(56) References Cited

U.S. PATENT DOCUMENTS

2019/0380197 A1* 12/2019 Lee ..... H05K 1/028
2020/0135063 A1* 4/2020 Jang ..... G06F 1/1652
2020/0154581 A1* 5/2020 Chen ..... H05K 1/028

FOREIGN PATENT DOCUMENTS

CM 211529514 U * 9/2020 ..... G09F 9/00
CN 1325041 A 12/2001
(Continued)

OTHER PUBLICATIONS

International Search Report issued on Sep. 28, 2021, in corresponding International Patent Application No. PCT/CN2021/107022, 6 pages.
(Continued)

*Primary Examiner* — Anthony D Stashick
*Assistant Examiner* — Marcos Javier Rodriguez Molina
(74) *Attorney, Agent, or Firm* — Maier & Maier, PLLC

(57) ABSTRACT

A protective bracket and a using method thereof. The protective bracket including: a main body part; an extension part extending outwardly from the main body part, at least part of the extension part being inclined relative to the main body part; a fixing part, extending from a free end of the extension part away from the main body part; a stopping part, connected to the main body part at a preset angle, in a thickness direction of the main body part, the fixing part and the stopping part being located at a same side of the main body part, and an end face of the fixing part away from the main body part being closer to the main body part than an end face of the stopping part away from the main body part.

17 Claims, 4 Drawing Sheets

(51) Int. Cl.
*G09F 9/30* (2006.01)
*G09F 9/33* (2006.01)
*H05K 5/02* (2006.01)

(58) Field of Classification Search
CPC .... B65D 81/05; B65D 85/30; B65D 19/0002; B65D 19/44; B65D 25/10; B65D 2519/00815; B65D 2519/00965; B65D 85/48; G09F 9/301; G09F 9/33; G09F 9/30; G09F 9/35; H05K 5/0217; H05K 5/03; H05K 1/028; H05K 1/0281; H05K 1/147; H05K 2201/056; H05K 3/30; H05K 5/0017; G02F 1/1333; G02F 1/133305; G02F 1/133308; G02F 1/133314; G02F 1/133317; G02F 1/133608; G02F 1/13452; G02F 2201/46; G02F 2202/28; G06F 1/1637; G06F 1/1652; G06F 2203/04102; G06F 3/0412; H01L 2251/5338; H01L 51/0097; H04M 1/0268; H10K 2102/311; H10K 59/131; H10K 59/873; H10K 77/111; Y02E 10/549; Y10T 29/49128; A44C 5/0015
USPC ..... 206/722
See application file for complete search history.

(56) References Cited

FOREIGN PATENT DOCUMENTS

| | | | | | |
|---|---|---|---|---|---|
| CN | 104851366 | A | | 8/2015 | |
| CN | 204904770 | U | * | 12/2015 | |
| CN | 106710452 | A | | 5/2017 | |
| CN | 106882454 | A | | 6/2017 | |
| CN | 105977400 | B | | 1/2018 | |
| CN | 107942563 | A | | 4/2018 | |
| CN | 108122496 | A | * | 6/2018 | ..... G02F 1/133305 |
| CN | 108520703 | A | | 9/2018 | |
| CN | 108682307 | A | | 10/2018 | |
| CN | 109036124 | A | * | 12/2018 | ..... G09F 9/00 |
| CN | 110648594 | A | | 1/2020 | |
| CN | 110662383 | A | | 1/2020 | |
| CN | 110718154 | A | | 1/2020 | |
| CN | 110908175 | A | * | 3/2020 | ..... G02F 1/133608 |
| CN | 111182772 | A | * | 5/2020 | ..... H05K 7/20963 |
| CN | 111338511 | A | | 6/2020 | |
| CN | 111640374 | A | | 9/2020 | |
| CN | 211529514 | U | * | 9/2020 | |
| CN | 111739412 | A | * | 10/2020 | ..... H10K 59/131 |
| CN | 112118699 | A | | 12/2020 | |
| DE | 4318045 | A1 | * | 12/1994 | ..... B65D 25/10 |
| JP | H0312636 | A | | 1/1991 | |

OTHER PUBLICATIONS

Office Action, with accompanying Machine Language Translation, issued on Apr. 28, 2022 in corresponding Chinese Application No. 202011142255.3, 18 pages.
Office Action, with accompanying Machine Language Translation, issued on Nov. 10, 2021 in corresponding Chinese Application No. 202011142255.3, 15 pages.
Office Action, with accompanying Machine Language Translation, issued on Apr. 18, 2022 in corresponding Chinese Application No. 202011142255.3, 17 pages.
Office Action, with accompanying Machine Language Translation, issued on Aug. 29, 2022 in corresponding Chinese Application No. 202011142255.3, 8 pages.

* cited by examiner

PROTECTIVE BRACKET AND USING METHOD THEREOF

CROSS REFERENCE TO RELATED APPLICATION

The application is a continuation of International Application No. PCT/CN2021/107022 filed on Jul. 19, 2021 and entitled "PROTECTIVE BRACKET AND USING METHOD THEREOF", which claims the priority benefits of Chinese Patent Application No. 202011142255.3 filed on Oct. 22, 2020, both of which are incorporated herein by reference in their entireties.

TECHNICAL FIELD

The application relates to the field of display device, in particular to a protective bracket and a using method thereof.

BACKGROUND

Currently, flexible display screens of display modules have the advantages of ultra-thin thickness, high screen-to-body ratio, bendability and the like. In particular, the OLED-based curved screen mobile phone brings about a higher hand-held feeling. In order to achieve a higher screen-to-body ratio, most of the flexible display screens employ COP (Chip On Pi) packaging process, where a part of flexible region of a flexible display screen provided with a driver IC or other circuit components is bent to the back side for packaging. However, the bent flexible region of the flexible display screen is exposed outside, and is susceptible to squeezing and collision during transportation of the display module, thereby causing the internal circuits of the flexible display screen to break and resulting in poor screen displaying.

SUMMARY

The application provides a protective bracket and a using method thereof, which can protect a flexible region of the display module during transport process of the display module and reduce a risk of circuit breakage in the display module.

In a first aspect, the application provides a protective bracket including: a main body part; an extension part extending outwardly from the main body part, at least part of the extension part being inclined relative to the main body part; a fixing part, extending from a free end of the extension part away from the main body part; a stopping part, connected to the main body part at a preset angle, in a thickness direction of the main body part, the fixing part and the stopping part being located at a same side of the main body part, and an end face of the fixing part away from the main body part being closer to the main body part than an end face of the stopping part away from the main body part.

Preferably, the protective bracket further comprises at least one support part, the at least one support part is connected to the main body part, and the at least one support part is located between the stopping part and the fixing part. The fixing part, the stopping part and the at least one support part are located at a same side of the main body part in the thickness direction of the main body part. When the display module vibrates during transportation, the support part can provide an effect of assisting in support, reduce shaking of the main body part, and prevent the main body part from crushing the flexible region.

Preferably, in the thickness direction of the main body part, an end face of the support part away from the main body part is closer to the main body part than the end face of the fixing part away from the main body part. In a normal state, the end face of the support part away from the main body part is spaced apart from the body region of the display module by a distance, so that direct contact between the support part and the body region of the display module can be avoided. When the display module vibrates during transportation, the support part can come into contact with the body region of the display module to support the main body part by the support part, thereby preventing the main body part from shaking downward excessively and squeezing the flexible region.

Preferably, in the thickness direction of the main body part, a distance between the end face of the fixing part away from the main body part and the main body part is D1, a distance between the end face of the stopping part away from the main body part and the main body part is D2, D2 is greater than D1, a difference value between D2 and D1 is greater than or equal to 0.5 mm, so as to avoid a failure of engagement between the stopping part and the body region of the display module.

Preferably, the extension part extends from an end of the main body part in a length direction of the main body part, a width direction of the main body part is perpendicular to the thickness direction of the main body part and the length direction of the main body part, a width of the main body part is larger than a width of the extension part in the width direction of the main body part, so as to reduce a weight of the protective bracket.

Preferably, the extension part is provided with a groove. By providing the groove, the weight of the protective bracket can be further reduced.

Preferably, the extension part comprises a transition region and an inclined region, the transition region extends from an end of the main body part in a direction away from the stopping part, the inclined region extends from an end of the transition region away from the main body part and is inclined relative to the transition region, the fixing part extends from an end of the inclined region away from the transition region. When the fixing part is fixed at the body region of the display module, the inclined region can prop up the main body part and separate the main body part from the body region of the display module by a preset distance.

Preferably, the stopping part comprises a base layer and a buffer layer, the base layer is connected to the main body part, the buffer layer is arranged at a side of the base layer close to the fixing part. Preferably, the base layer is provided integrally with the main body part. Preferably, a material of the buffer layer comprises foam. The buffer layer can provide an effect of buffering, reduce a pressure and frictional force applied to an edge of the body region of the display module, and reduce a risk of breakage and chipping of the edge of the body region of the display module.

Preferably, the fixing part includes a connection layer and an adhesive layer, the connection layer is connected to the extension part, and the adhesive layer is arranged on a surface of the connection layer away from the main body part in the thickness direction of the main body part. Preferably, the connection layer is shaped as a plate, and the connection layer is arranged in parallel with the main body part. Preferably, the adhesive layer is a double-sided adhesive tape.

In a second aspect, the application proposes a using method for the protective bracket according to the first aspect, including: providing a display module, the display module including a body region and a flexible region connected to the body region, the body region comprising a first surface and a second surface opposite to each other, the flexible region being bent to the second surface; abutting the stopping part of the protective bracket against an edge of the body region, arranging the main body part of the protective bracket at a side of the flexible region away from the second surface, fixing the fixing part of the protective bracket to the second surface.

The application abuts the stopping part against an edge of the body region, arranges the main body part at a side of the flexible region away from the second surface, and fixes the fixing part to the second surface. The main body part can protect the flexible region from the outside, so as to prevent the flexible region from being squeezed, prevent breakage of the circuit and improve product yield. The stopping part can be pressed against the edge of the body region from the outside, so that the stopping part is engaged with the body region, improving the connection strength between the display module and the protective bracket and reducing a risk of shaking of the main body part. At the same time, the stopping part can also provide an effect of positioning in the process of assembling the display module and the protective bracket, thereby simplifying the assembly process.

DETAILED DESCRIPTION

The features and embodiments of the application in various aspects will be described in detail below. For clearly understanding of the purpose, technical solution and advantages of the application, the application will be described in further details in combination with the drawings and specific embodiments. It should be noted that the specific embodiments described herein are configured to explain the application rather than to limit it.

Figure 1:
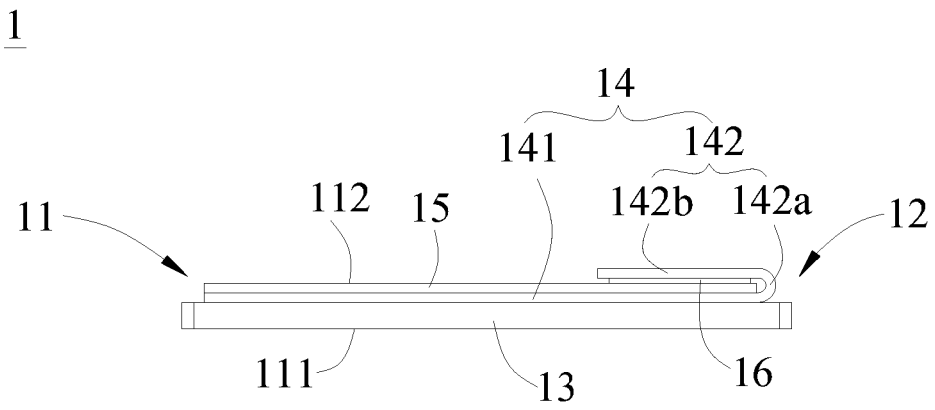
FIG. 1 shows a schematic structural view of a display module of the application.

The protective bracket provided in the application is used to protect the display module 1 during transportation. In particular, referring to FIG. 1, the display module 1 includes a body region 11 and a flexible region 12 connected to the body region 11. The body region 11 has a first surface 111 and a second surface 112 opposite to each other, and the flexible region 12 can be bent to the second surface 112.

The display module 1 includes a cover plate 13, a flexible display screen 14 fixed on a side of the cover plate 13, and a buffer layer 15 arranged at a side of the flexible display screen 14 away from the cover plate 13. The cover plate 13 may be a glass flat plate or a glass curved plate. The flexible display screen 14 is made of a flexible material, and has the advantages of ultra-thin thickness, high screen-to-body ratio, bendability and the like. The flexible display screen 14 has a display region 141 and a non-display region 142. The display region 141 is fixed to the cover plate 13. The non-display region 142 extends from an end of the display region 141, and the non-display region 142 is internally provided with a metal wire for transmitting a signal of the display region 141. The non-display region 142 may also be connected to structures such as a drive chip, a flexible circuit board and the like. The buffer layer 15 is arranged on the display region 141, and may be formed by compounding foam and copper foil.

In order to increase the screen-to-body ratio, the non-display region 142 is usually bent to the side of the display region 141 away from the cover plate 13. In particular, the non-display region 142 includes an arc-shaped bent section 142*a* and an explanate flat section 142*b*. The flat section 142*b* is located at a side of the buffer layer 15 away from the display region 141 and is used for connecting to structures such as a drive chip, a flexible circuit board and the like. The bent section 142*a* is connected between the display region 141 and the flat section 142*b*. The display module 1 further includes a support block 16 arranged between the flat section 142*b* and the buffer layer 15, and the support block 16 can support the flat section 142*b* from the lower side. At this time, the body region 11 includes the cover plate 13, the display region 141 of the flexible display screen 14 and the buffer layer 15, and the flexible region 12 includes the non-display region 142 of the flexible display screen 14. The first surface 111 is the surface of the cover plate 13 away from the display region 141, and the second surface 112 is the surface of the buffer layer 15 away from the cover plate 13.

The display module 1 is usually transported by using a pallet. In particular, the pallet includes a plurality of cavities, and the display module 1 is put into the cavity of the pallet with the cover plate 13 of the display module 1 facing downward, and the non-display region 142 of the display module 1 faces upward and is exposed to the outside, and then a plurality of pallets filled of display modules 1 are stacked in turn, and at last the plurality of pallets filled of display modules 1 are wrapped with adhesive tapes to secure, ready for packaging and shipment.

However, before the display module 1 is assembled into a complete appliance, processes such as packaging and transportation are required. The upper side of the flat section 142*b* and the two sides of the bent section 142*a* of the non-display region 142 have no protection or buffer structures, and are susceptible to squeezing and collision, thereby causing the internal circuits to break and resulting in poor displaying of the screen body. Therefore, the protective bracket provided in the application may be used to protect the display module 1 during transportation.

The protective bracket provided in the application will be described in detail below with reference to the accompanying drawings.

Figure 2:
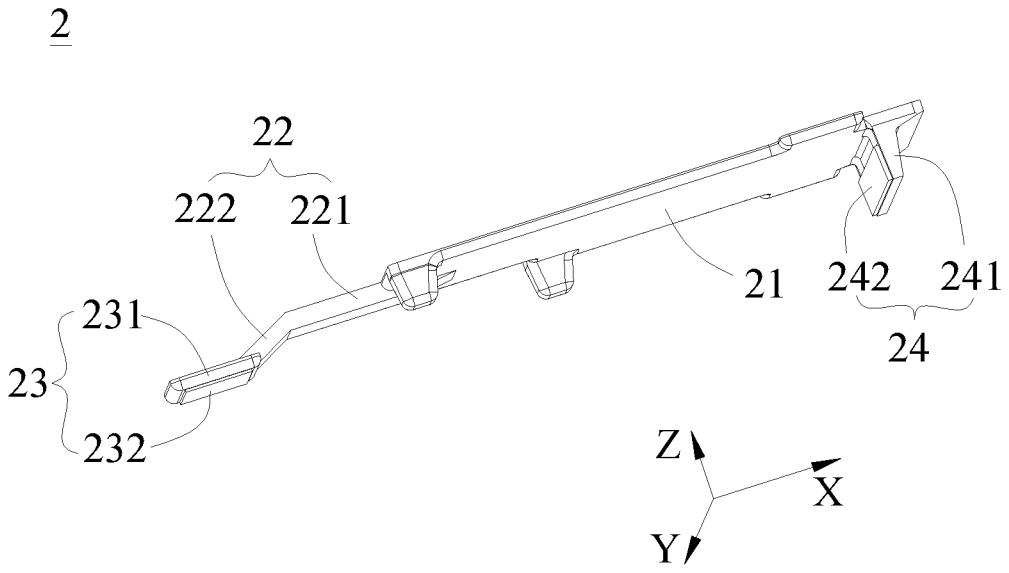
FIG. 2 shows a schematic structural view of a protective bracket of the application.
Figure 3:
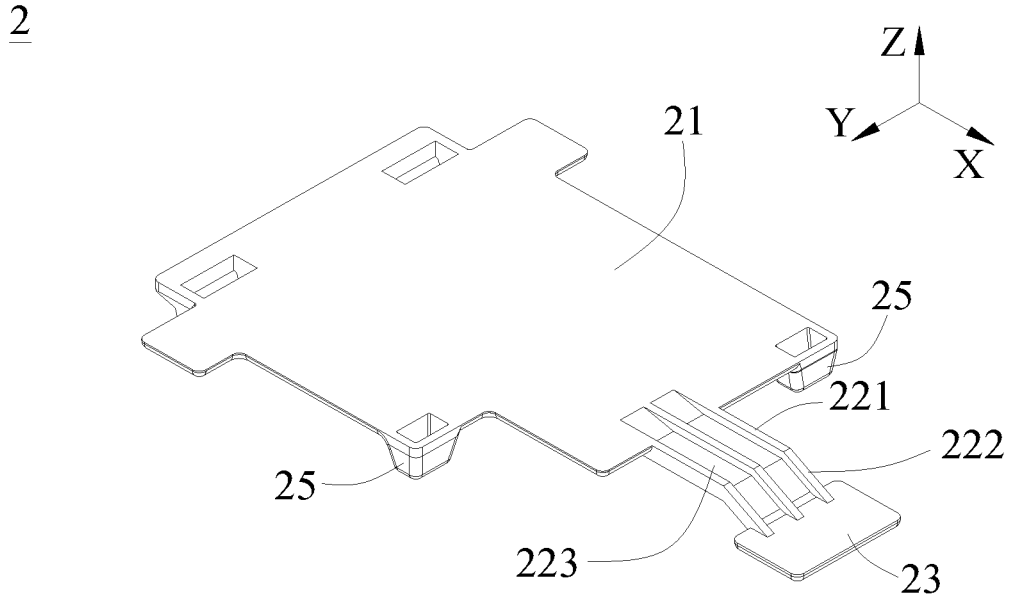
FIG. 3 shows a schematic structural view of the protective bracket as shown in FIG. 2 from another perspective.
Figure 4:
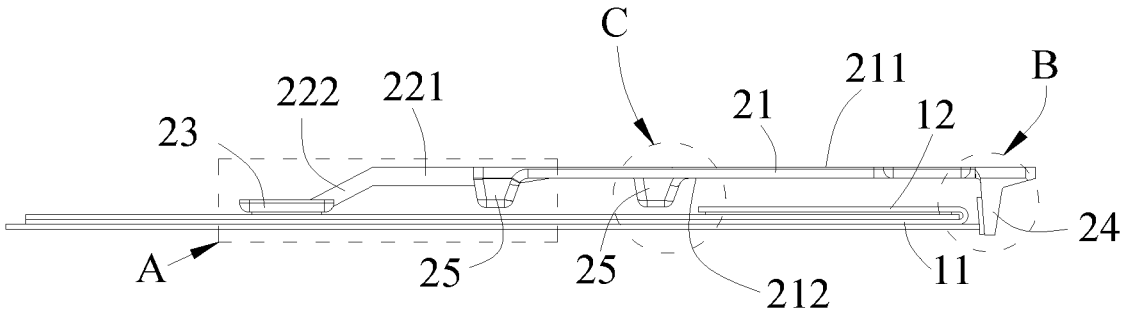
FIG. 4 is a schematic view after assembly of the protective bracket as shown in FIG. 2 and the display module as shown in FIG. 1.

Referring to FIGS. 2 to 4, the protective bracket 2 provided in the application includes a main body part 21, an extension part 22, a fixing part 23 and a stopping part 24.

The main body part 21 is shaped as a plate. The main body part 21 is generally a flat plate with a uniform thickness. In a thickness direction Z of the main body part 21, the main body part 21 includes an upper surface 211 and a lower surface 212 arranged opposite to each other, and the upper surface 211 and the lower surface 212 are arranged in parallel and are generally planar.

The extension part 22 extends outwardly from the main body part 21. The extension part 22 may extend outwardly from an end of the main body part 21. In this embodiment, the extension part 22 extends outwardly from an end of the main body part 21 in the length direction X thereof. In other embodiments, the extension part 22 may also extend outwardly from an end of the main body part 21 in the width direction Y thereof. The extension part 22 may also extend downward from the lower surface 212 of the main body part 21.

At least part of the extension part 22 is inclined relative to the main body part 21. In particular, at least part of the extension part 22 is inclined toward a side of the main body part 21 in the thickness direction Z. In particular, in the thickness direction Z, at least part of the extension part 22 is located at the side of the lower surface 212 away from the upper surface 211.

The fixing part 23 extends from a free end of the extension part 22 away from the main body part 21. The fixing part 23 is used to be fixed to the second surface 112 of the body region 11 of the display module 1. The fixing part 23 is shaped as a flat plate, and the fixing part 23 is arranged in parallel with the main body part 21.

The stopping part 24 is connected to the main body part 21 at a preset angle. The stopping part 24 extends downward from the lower surface 212 of the main body part 21, and the stopping part 24 is shaped as a plate. An included angle between the stopping part 24 and the main body part 21 may be 70-110 degrees.

In the thickness direction Z of the main body part 21, the fixing part 23 and the stopping part 24 are located at a same side of the main body part 21. The end face of the fixing part 23 away from the main body part 21 (hereinafter referred to as the first end face 233) is closer to the main body part 21 than the end face of the stopping part 24 away from the main body part 21 (hereinafter referred to as the second end face 243). Both the fixing part 23 and the stopping part 24 are located at the lower side of the lower surface 212. In the thickness direction Z, the distance between the first end face 233 and the main body part 21 is D1, and the distance between the second end face 243 and the main body part 21 is D2. D2 is greater than D1.

When the display module 1 is required to be transported, the protective bracket 2 is installed on the display module 1 at first. In particular, referring to FIG. 8, at first, the display module 1 to be transported is placed on a support surface of a jig 3 with the flexible region 12 facing upward; then the protective bracket 2 is tilted and placed onto a guide groove 31 on a side of the support surface, where the guide groove 31 is recessed relative to the support surface, and the stopping part 24 is in sliding fit with the guide groove 31 of the jig 3; then again, the protective bracket 2 is pushed toward the display module 1, and when the stopping part 24 abuts against the edge of the body region 11, the protective bracket 2 is rotated with the contact portion of the stopping part 24 and the body region 11 as the axis, so that the fixing part 23 is fitted and fixed to the second surface 112. Finally, the display module 1 and the protective bracket 2 fixed together can enter the transportation stage. When the display module 1 is required to be assembled with other components to form a complete appliance, the protective bracket 2 may be removed.

After the display module 1 and the protective bracket 2 are assembled together, the main body part 21 is located at the side of the flexible region 12 away from the body region 11 and is spaced apart from the flexible region 12 by a certain distance. Therefore, the main body part 21 can protect the flexible region 12 from the outside, so as to prevent the flexible region 12 from being squeezed, prevent breakage of the circuit and improve product yield. The first end face 233 is closer to the main body part 21 than the second end face 243. When the fixing part 23 is fixed to the second surface 112, the second end face 243 can exceed the second surface 112 in the direction away from the main body part 21. Therefore, the stopping part 24 can be pressed against the edge of the body region 11 from the outside, so that the stopping part 24 is engaged with the body region 11, improving the connection strength between the display module 1 and the protective bracket 2 and reducing the risk of shaking of the main body part 21. At the same time, the stopping part 24 can also provide an effect of positioning in the process of assembling the display module 1 and the protective bracket 2, thereby simplifying the assembly process.

Figure 5:
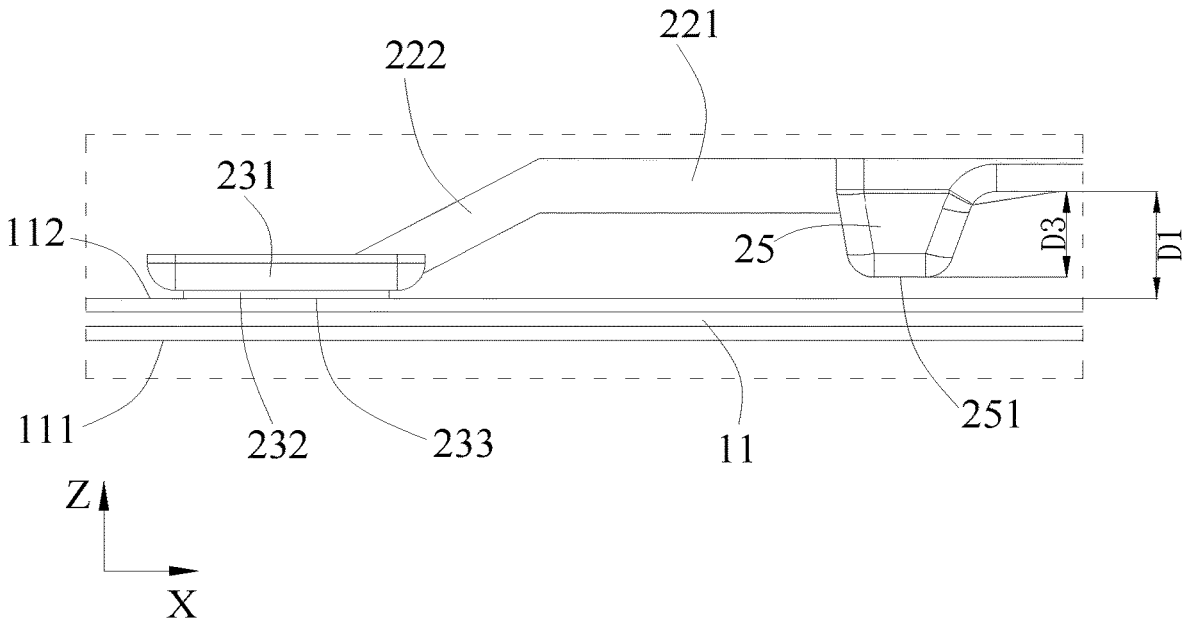
FIG. 5 shows an enlarged view of a boxed portion A of FIG. 4.

Referring to FIGS. 4 and 5, the protective bracket 2 further includes at least one support part 25. The support part 25 is connected to the main body part 21, and the support part 25 is located between the stopping part 24 and the fixing part 23. The fixing part 23, the stopping part 24 and the support part 25 are located at a same side of the main body part 21 in the thickness direction Z. The support part 25 protrudes downward relative to the lower surface 212, and the support part 25 is located between the fixing part 23 and the stopping part 24 in the length direction X. The support part 25 may be provided in plural.

The support part 25 should be arranged to avoid the flexible region 12, that is, when the fixing part 23 is fixed to the body region 11, the support part 25 does not overlap with the flexible region 12 in the thickness direction Z, thereby preventing the support part 25 from crushing the flexible region 12. When the display module 1 vibrates during transportation, the support part 25 can provide an effect of assisting in support, reduce shaking of the main body part 21, and prevent the main body part 21 from crushing the flexible region 12.

Figure 7:
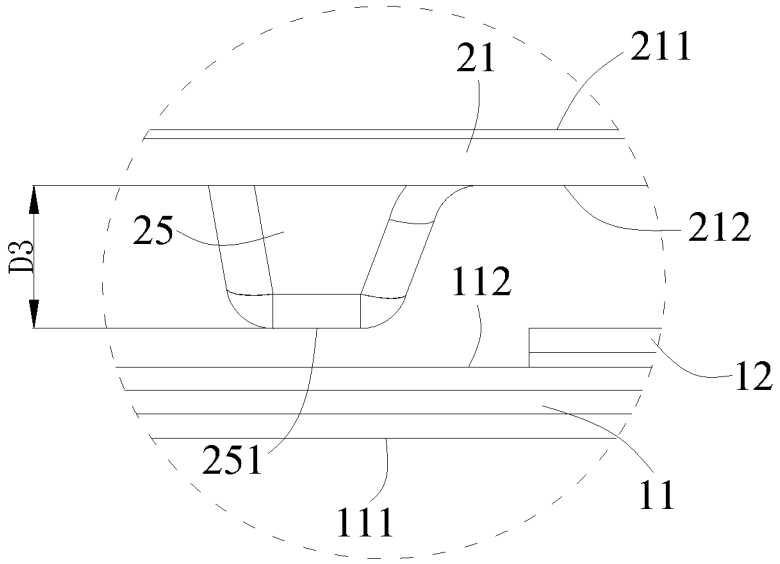
FIG. 7 shows an enlarged view of a circled portion C of FIG. 4.

Referring to FIGS. 5 and 7, in the thickness direction Z, the end face of the support part 25 away from the main body part 21 (hereinafter referred to as the third end face 251) is closer to the main body part 21 than the first end face 233 of the fixing part 23 away from the main body part 21. The distance between the third end face 251 and the main body part 21 is D3, and D3 is smaller than D1. In a normal state, the first end face 233 of the fixing part 23 abuts against the second surface 112 of the body region 11. Since D3 is smaller than D1, the third end face 251 is spaced apart from the second surface 112 by a certain distance, so that a direct contact between the support part 25 and the second surface 112 can be avoided. When the display module 1 vibrates during transportation, the support part 25 can come into contact with the second surface 112, that is, the body region 11 supports the main body part 21 by the support part 25, thereby preventing the main body part 21 from shaking downward excessively and squeezing the flexible region 12.

If the difference value between D2 and D1 is too small, the area of the portion of the stopping part 24 capable of contacting the body region 11 is small, and the engagement between the stopping part 24 and the body region 11 is liable to failure. Therefore, preferably, the difference value between D2 and D1 is greater than or equal to 0.5 mm.

In the direction away from the main body part 21, the size of the second end face 243 exceeding the first surface 111 is greater than or equal to 0.5 mm. When the display module 1 vibrates during transportation, even if the stopping part 24 slides relative to the body region 11, the engagement between the stopping part 24 and the body region 11 can also be ensured.

Referring to FIG. 3, the extension part 22 extends from an end of the main body part 21 in the length direction X of the main body part 21. The width direction Y of the main body part 21 is perpendicular to the thickness direction Z of the main body part 21 and the length direction X of the main body part 21. In the width direction Y of the portion 21, the width of the main body part 21 is greater than the width of the extension part 22. By reducing the width of the extension part 22, the weight of the protective bracket 2 can be reduced.

The extension part 22 is provided with a groove 223. By arranging the groove 223, the weight of the protective bracket 2 can be further reduced.

Referring to FIGS. 3 to 5, the extension part 22 includes a transition region 221 and an inclined region 222. The transition region 221 extends from an end of the main body part 21 in the direction away from the stopping part 24. The inclined region 222 extends from an end of the transition region 221 away from the main body part 21 and is inclined relative to the transition region 221. The fixing part 23 extends from an end of the inclined region 222 away from the transition region 221. In particular, the transition region 221 extends from the end of the main body 21 in the length direction X, and the extension direction of the transition region 221 is parallel to the length direction X; the inclined region 222 is inclined toward a side of the transition region 221, and the included angle between the inclined region 222 and the transition region 221 is an obtuse angle. When the fixing part 23 is fixed to the second surface 112, the inclined region 222 can prop up the main body part 21 and separate the main body part 21 from the second surface 112 by a preset distance.

Figure 6:
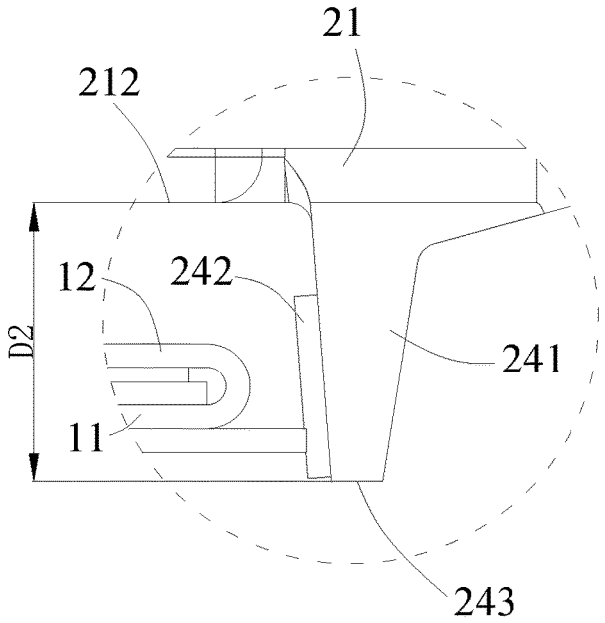
FIG. 6 shows an enlarged view of a circled portion B of FIG. 4.

Referring to FIG. 6, the stopping part 24 includes a base layer 241 and a buffer layer 242. The base layer 241 is connected to the main body part 21, and the buffer layer 242 is arranged at a side of the base layer 241 close to the fixing part 23. After the display module 1 and the protective bracket 2 are assembled together, the buffer layer 242 is sandwiched between the base layer 241 and an edge of the body region 11. The buffer layer 242 can provide an effect of buffering, reduce the pressure and frictional force applied by the stopping part 24 on the edge of the body region 11, and reduce the risk of breakage and chipping of the edge of the body region 11. Preferably, the base layer 241 is provided integrally with the main body part 21, and a material of the buffer layer 242 comprises foam.

Referring to FIG. 5, the fixing part 23 includes a connection layer 231 and an adhesive layer 232. The connection layer 231 is connected to the extension part 22. The adhesive layer 232 is arranged on a surface of the connection layer 231 away from the main body part 21 in the thickness direction Z. The adhesive layer 232 is used to adhere the connection layer 231 to the second surface 112 of the body region 11. The connection layer 231 is shaped as a plate and arranged in parallel to the main body part 21. Two surfaces of the adhesive layer 232 in the thickness direction Z are used to be adhered to the connection layer 231 and the second surface 112 respectively. The surface of the adhesive layer 232 adhered to the second surface 112 is the first end face 233 of the fixing part 23. Preferably, the adhesive layer 232 is a double-sided adhesive tape.

The main body part 21, the extension part 22, the connection layer 231 and the base layer 241 are integrally formed. The buffer layer 242 is adhered to the base layer 241, and the adhesive layer 232 is adhered to the connection layer 231.

The application further provides a using method of the aforesaid protective bracket 2. The method includes:

providing a display module 1, the display module 1 including a body region 11 and a flexible region 12 connected to the body region 11, the body region 11 comprising a first surface 111 and a second surface 112 opposite to each other, the flexible region 12 being bent to the second surface 112.

abutting the stopping part 24 against an edge of the body region 11, arranging the main body part 21 at a side of the flexible region 12 away from the second surface 112, fixing the fixing part 23 to the second surface 112.

Figure 8:
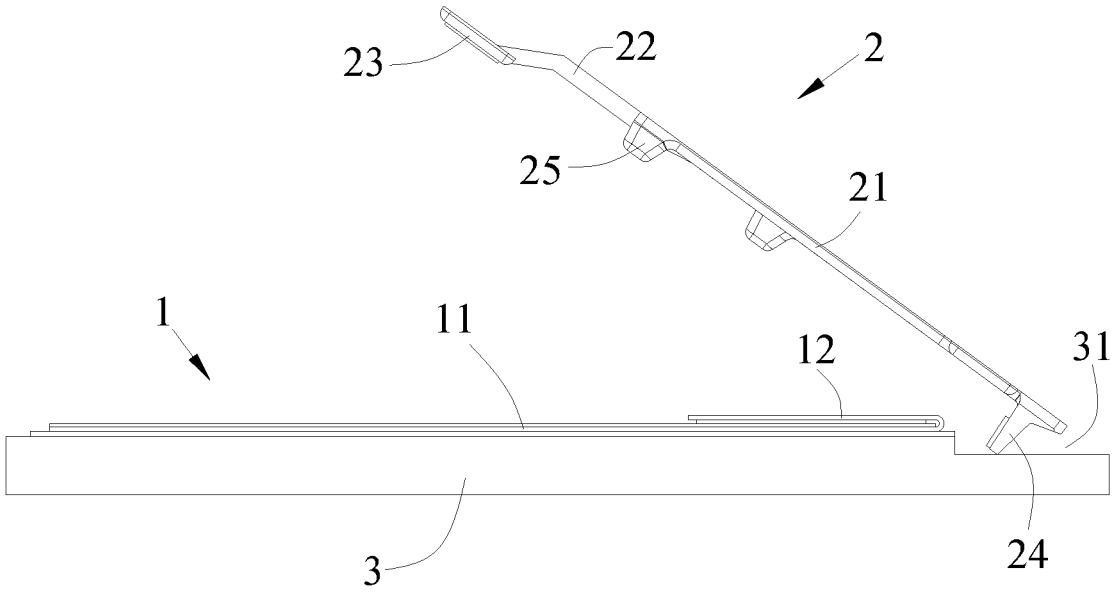
FIG. 8 shows a schematic view of an assembly process of the protective bracket as shown in FIG. 2 and the display module as shown in FIG. 1.

In particular, referring to FIG. 8, at first, the display module 1 to be transported is placed on a support surface of a jig 3 with the flexible region 12 facing upward; then the protective bracket 2 is tilted and placed onto a guide groove 31 on a side of the support surface, where the guide groove 31 is recessed relative to the support surface, and the stopping part 24 is in sliding fit with the guide groove 31 of the jig 3; then again, the protective bracket 2 is pushed toward the display module 1, and when the stopping part 24 abuts against the edge of the body region 11, the protective bracket 2 is rotated with the contact portion of the stopping part 24 and the body region 11 as the axis, so that the fixing part 23 is fitted and fixed to the second surface 112. Finally, the display module 1 and the protective bracket 2 fixed together can enter the transportation stage. When the display module 1 is required to be assembled with other components to form a complete appliance, the protective bracket 2 may be removed.

In accordance with the embodiments of the application as described above, these embodiments are not intended to be exhaustively set forth all the details, nor are they intended to limit the application to the specific embodiments described. It will be apparent that many modifications and variations are possible from the above description. These embodiments have been chosen and described in detail in the description in order to better explain the principle and practical application of the application, thereby enabling a person skilled in the art to make better use of the application and its modifications. The application is limited only by the claims and their full scope and equivalents.

What is claimed is:

1. A using method for a protective bracket, the protective bracket comprising:

a main body part;

an extension part, extending outwardly from the main body part, at least part of the extension part being inclined relative to the main body part, wherein the extension part is provided with a groove;

a fixing part, extending from a free end of the extension part away from the main body part;

a stopping part, connected to the main body part at a preset angle, in a thickness direction of the main body part, the fixing part and the stopping part being located at a same side of the main body part, and an end face of the fixing part away from the main body part being closer to the main body part than an end face of the stopping part away from the main body part;

in the thickness direction of the main body part, a distance between the end face of the fixing part away from the main body part and the main body part is D1, a distance between the end face of the stopping part away from the main body part and the main body part is D2, D2 is greater than D1, a difference value between D2 and D1 is greater than or equal to 0.5 mm;

wherein the using method comprising:

providing a display module, the display module comprising a body region and a flexible region connected to the body region, the body region comprising a first surface and a second surface opposite to each other, the flexible region being bent to the second surface;

the display module to be transported is placed on a support surface of a jig with the flexible region facing upward; the protective bracket is tilted and placed onto a guide groove on a side of the support surface, where the guide groove is recessed relative to the support surface, and the stopping part is in sliding fit with the guide groove of the jig;

abutting the stopping part of the protective bracket against an edge of the body region, the protective bracket is rotated with the contact portion of the stopping part and the body region as the axis, arranging the main body part of the protective bracket at a side of the flexible region away from the second surface, fixing the fixing part of the protective bracket to the second surface.

2. A protective bracket, comprising:

a main body part;

an extension part, extending outwardly from the main body part, at least part of the extension part being inclined relative to the main body part;

a fixing part, extending from a free end of the extension part away from the main body part;

a stopping part, connected to the main body part at a preset angle, in a thickness direction of the main body part, the fixing part and the stopping part being located at a same side of the main body part, and an end face of the fixing part away from the main body part being closer to the main body part than an end face of the stopping part away from the main body part;

in the thickness direction of the main body part, a distance between the end face of the fixing part away from the main body part and the main body part is D1, a distance between the end face of the stopping part away from the main body part and the main body part is D2, D2 is greater than D1, a difference value between D2 and D1 is greater than or equal to 0.5 mm;

wherein the protective bracket further comprising a using method comprising:

providing a display module, the display module comprising a body region and a flexible region connected to the body region, the body region comprising a first surface and a second surface opposite to each other, the flexible region being bent to the second surface;

the display module to be transported is placed on a support surface of a jig with the flexible region facing upward; the protective bracket is tilted and placed onto a guide groove on a side of the support surface, where the guide groove is recessed relative to the support surface, and the stopping part is in sliding fit with the guide groove of the jig;

abutting the stopping part of the protective bracket against an edge of the body region, the protective bracket is rotated with the contact portion of the stopping part and the body region as the axis, arranging the main body part of the protective bracket at a side of the flexible region away from the second surface, fixing the fixing part of the protective bracket to the second surface.

3. The protective bracket according to claim 2, wherein the protective bracket further comprises at least one support part, the at least one support part is connected to the main body part, and the at least one support part is located between the stopping part and the fixing part;

the fixing part, the stopping part and the at least one support part are located at a same side of the main body part in the thickness direction of the main body part.

4. He protective bracket according to claim 3, wherein in the thickness direction of the main body part, an end face of the support part away from the main body part is closer to the main body part than the end face of the fixing part away from the main body part.

5. The protective bracket according to claim 3, wherein the at least one support part comprises a plurality of support parts for reducing shaking of a display module.

6. The protective bracket according to claim 5, wherein the display module includes a body region and a flexible region connected to the body region, the body region has a first surface and a second surface opposite to each other, and the flexible region can be bent to the second surface; the support part is arranged to avoid the flexible region, when the fixing part is fixed to the body region in the thickness direction.

7. The protective bracket according to claim 2, wherein the extension part extends from an end of the main body part in a length direction of the main body part, a width direction of the main body part is perpendicular to the thickness direction of the main body part and the length direction of the main body part, a width of the main body part is larger than a width of the extension part in the width direction of the main body part.

8. The protective bracket according to claim 2, wherein the extension part comprises a transition region and an inclined region, the transition region extends from an end of the main body part in a direction away from the stopping part, the inclined region extends from an end of the transition region away from the main body part and is inclined relative to the transition region, the fixing part extends from an end of the inclined region away from the transition region.

9. The protective bracket according to claim 8, wherein the transition region extends from the end of the main body part in the length direction of the main body part, an included angle between the inclined region and the transition region is an obtuse angle.

10. The protective bracket according to claim 2, wherein the main body part and the fixing part are arranged in parallel.

11. The protective bracket according to claim 10, wherein the main body part is shaped as a flat plate, and the fixing part is shaped as a flat plate.

12. The protective bracket according to claim 11, wherein the stopping part is shaped as a plate, and an included angle between the stopping part and the main body part is 70-110 degrees.

13. The protective bracket according to claim 2, wherein the stopping part comprises a base layer and a buffer layer, the base layer is connected to the main body part, the buffer layer is arranged at a side of the base layer close to the fixing part.

14. The protective bracket according to claim 13, wherein the base layer is provided integrally with the main body part.

15. The protective bracket according to claim 2, wherein the fixing part comprises a connection layer and an adhesive layer, the connection layer is connected to the extension part, the adhesive layer is arranged on a surface of the connection layer away from the main body part in the thickness direction of the main body part.

16. The protective bracket according to claim 15, wherein the connection layer is shaped as a plate, and the connection layer is arranged in parallel with the main body part.

17. The protective bracket according to claim 15, wherein the connection layer, the extension part and the main body part are integrally formed.

* * * * *